US007874709B1

(12) United States Patent
Beadle

(10) Patent No.: US 7,874,709 B1
(45) Date of Patent: Jan. 25, 2011

(54) RECESSED LIGHTING FIXTURE WITH MULTIPLE ADJUSTMENT AXES

(75) Inventor: Joshua Z. Beadle, San Diego, CA (US)

(73) Assignee: Hunter Industries Incorporated, San Marcos, CA (US)

( * ) Notice: Subject to any disclaimer, the term of this patent is extended or adjusted under 35 U.S.C. 154(b) by 302 days.

(21) Appl. No.: 12/266,834

(22) Filed: Nov. 7, 2008

Related U.S. Application Data

(60) Provisional application No. 60/988,078, filed on Nov. 14, 2007.

(51) Int. Cl.
*F21V 19/02* (2006.01)
*F21V 21/26* (2006.01)

(52) U.S. Cl. ..... 362/365; 362/285; 362/287; 362/427

(58) Field of Classification Search ..... 362/365, 362/158, 364, 366, 267, 285, 287, 289, 418, 362/427–430
See application file for complete search history.

(56) References Cited

U.S. PATENT DOCUMENTS

| | | | | |
|---|---|---|---|---|
| 2,886,630 | A | 5/1959 | Gill | |
| 3,530,330 | A | 9/1970 | Dupree | |
| 3,660,651 | A * | 5/1972 | Miles, Jr. | 362/366 |
| 3,772,527 | A | 11/1973 | Darling et al. | |
| 4,180,850 | A | 12/1979 | Bivens | |
| 4,290,094 | A | 9/1981 | Jensen | |
| 4,410,933 | A * | 10/1983 | Blake et al. | 362/371 |
| 4,419,721 | A * | 12/1983 | Gregoire et al. | 362/368 |
| 4,471,416 | A | 9/1984 | Druffel | |
| 4,539,629 | A | 9/1985 | Poppenheimer | |
| 4,599,485 | A | 7/1986 | Smolik | |
| 4,634,015 | A | 1/1987 | Taylor | |
| 4,760,510 | A | 7/1988 | Lahti | |
| 4,941,071 | A | 7/1990 | Knauf | |
| 5,003,441 | A | 3/1991 | Crowe | |
| 5,072,345 | A | 12/1991 | Goggia | |
| 5,156,454 | A | 10/1992 | White | |
| 5,222,303 | A | 6/1993 | Jardine | |
| 5,222,800 | A | 6/1993 | Chan et al. | |
| 5,230,559 | A | 7/1993 | Porter et al. | |
| 5,408,397 | A | 4/1995 | Tyson | |
| 5,414,607 | A | 5/1995 | Harris et al. | |

(Continued)

*Primary Examiner*—Bao Q Truong
(74) *Attorney, Agent, or Firm*—Eleanor Musick; Procopio, Cory, Hargreaves & Savitch, LLP

(57) ABSTRACT

The recessed fixture includes a cylindrical housing assembly that encloses a lamp assembly in a watertight enclosure. The lamp assembly includes an attachment base bracket attached to the interior of the housing, and a U-shaped bracket that is rotatably attached to the base bracket. The U-shaped bracket includes attachment means that permit vertical and angular adjustment of the lamp assembly relative to the axial center of the housing. The combination of the pivot points and the ability to rotate the lamp housing about the base bracket provides at least three axes of adjustability to permit variation of the character of light emitted from the fixture. A cover placed over the end of the housing seals a lens to the housing to produce a watertight seal. The cover may include a pattern of ridges and openings to form a baffle to further protect the lens, reduce glare and provide additional directional control of the emitted light. The cylindrical housing fits within a sleeve that is positioned generally flush with the surface in which the fixture is being recessed, allowing the fixture to be accessed for installation and maintenance.

24 Claims, 18 Drawing Sheets

U.S. PATENT DOCUMENTS 5,481,443 A 1/1996 Wagner et al.
5,486,988 A 1/1996 Tyson
5,506,761 A 4/1996 Strauss
5,548,499 A * 8/1996 Zadeh ..... 362/366
5,564,815 A 10/1996 Littman
5,584,574 A 12/1996 Haddad
5,649,760 A 7/1997 Beadle
5,727,873 A 3/1998 Tyson
5,738,700 A 4/1998 King
5,743,622 A 4/1998 Ibbitson et al.
5,908,236 A 6/1999 Lueken et al.
5,967,354 A 10/1999 Whitehead et al.
5,988,833 A 11/1999 Giese et al.
6,036,337 A * 3/2000 Belfer ..... 362/287
6,106,134 A 8/2000 Bomas
6,431,723 B1 8/2002 Schubert et al.
6,491,407 B1 12/2002 Beadle
6,502,967 B2 * 1/2003 Mullen ..... 362/427
6,517,216 B1 2/2003 Cercone et al.
6,612,720 B1 9/2003 Beadle
6,779,907 B2 8/2004 Beadle
6,796,684 B1 9/2004 Beadle
7,320,533 B1 * 1/2008 Beadle ..... 362/285
7,370,988 B2 * 5/2008 Hagen ..... 362/153
7,434,967 B2 * 10/2008 Dupre ..... 362/366
2003/0057302 A1 3/2003 Swan
2003/0170442 A1 9/2003 Kaminsky et al.

* cited by examiner

RECESSED LIGHTING FIXTURE WITH MULTIPLE ADJUSTMENT AXES

RELATED APPLICATIONS

This application claims the priority of U.S. Provisional Application No. 60/988,078, filed Nov. 14, 2007, which is incorporated herein by reference in its entirety.

FIELD OF THE INVENTION

The present invention relates to lighting fixtures for landscape and environmental lighting applications and, more particularly, to recessed lighting for placement in the ground or in walls.

BACKGROUND OF THE INVENTION

The use of outdoor lighting fixtures is becoming increasingly popular for illuminating buildings, gardens, pathways, and entrance ways as the nighttime play of light on the landscape and exterior structures is aesthetically pleasing. Lighting of outdoor ponds, pools, water falls, brooks, streams, and water fountains enhances the overall appeal of outdoor lighting. Additionally, such lighting provides enhanced security by reducing or eliminating dark hiding places and unobserved entry points for intruders. The most widely used outdoor lighting systems include one or more low voltage lighting fixtures that are connected to a 12 V transformer that is, in turn, connected to a standard 120 VAC line. The outdoor lighting typically is turned on and off by an automatic timer but may be turned on and off manually as desired. Each lighting fixture generally includes a housing, a lamp assembly having a halogen lamp or conventional bulb, a reflector, and a lens or window. Many configurations are known for providing a variety of different lighting effects.

Landscape lighting fixtures, most of which are mounted at or above ground level can be considered to appear somewhat incongruous with the surrounding vegetation during daylight hours, when the illumination function is not in use. Further, because of the constant exposure to the elements, above ground lighting fixtures are generally required to be made of expensive, high quality materials, such as non-corrosive metal alloys, in order to provide durability and a reasonable resistance to damage so as not to appear cheap and unkempt.

As an alternative to the above-ground placement of landscape lighting fixtures, recessed, in-ground lighting fixtures, also known as "well lights", have gained widespread acceptance. In certain applications, the use of below-ground landscape lighting is preferable over above-ground varieties, especially in areas surrounding walkways where an above-ground element could pose a tripping hazard or in lawn areas where the use of a lawn mower presents a risk of damage to the fixture. One such in-ground lighting fixture is described in U.S. Pat. No. 6,491,407 of Beadle, which is incorporated herein by reference. Underwater lighting fixtures are similar to in-ground lighting fixtures with the added requirement that they must be waterproof. Most in-ground light fixtures are not waterproof but are sufficiently water resistant that they may still be placed in wet ground, but not designed to be immersed under water.

A problem experienced with below-ground light fixtures as well as underwater light fixtures is the limited ability to control the direction of illumination efficiently and easily due to the limited range of illumination and convenient access to the lamp. It would be an advantage to have an apparatus in which the lamp is easily accessible to the user for adjustment of beam quality, color and angle.

Some existing lighting fixtures are designed to be placed in the ground with their faces parallel with the ground. Some underwater lighting fixtures are designed to be placed just below the surface of the water while others are placed deeper in the water. Other fixtures have their upper edge cut at an angle, so that the exit window is at shallow angle relative to the surface of the ground or of the water, and one side of the fixture may extend slightly above the surface. The fixture is selected according to the position of the exit face—there is no variability once the fixture is selected, short of digging the hole in the ground at a different, non-vertical angle, which tends to be imprecise.

The need remains for an in-ground, waterproof lighting fixture that provides variability in the position of the lamp to permit adjustment of the beam and more efficient use of the light. The present invention is directed to such a fixture.

BRIEF SUMMARY OF THE INVENTION

It is an advantage of the present invention to provide recessed (in ground or in wall) lighting fixture that permits adjustment on at least three different axes for controlling the light beam emitted from the fixture.

It is an additional advantage of the present invention to provide a recessed lighting fixture that is waterproof and capable of being fully submerged in water.

Still another advantage of the present invention is to provide a recessed lighting fixture that is easily installed and easily removed for maintenance or modification of the properties of light emitted by the fixture.

In an exemplary embodiment, the recessed, or "well light", fixture comprises a cylindrical housing with an open output end and a closed inner end. The output end has a flange with an annular recess for receiving a lens or window. An O-ring is placed over the edge of the lens and sandwiched between the surface of the annular recess of the flange and a protective cover to provide a watertight seal. The cover may include a pattern of ridges and openings to form a baffle to further protect the lens, reduce glare and provide additional direction of the light.

In the preferred embodiment, a lamp assembly disposed within the interior of the housing includes an attachment base bracket, and a U-shaped bracket that is rotatably attached to the base bracket. The U-shaped bracket may have an angled slot on each of the upper arms for pivotable attachment of the lamp housing or, alternatively, a separate connector that slides onto the upper arms to allow the lamp housing to travel vertically while allowing the lamp housing to pivot about the attachment points. The combination of the pivot points and their corresponding connectors/slots allows the position of the lamp assembly to be adjusted axially within the housing. The combination of the pivot points and the ability to rotate the lamp housing about the base bracket forms a gimble for varying the angle of the lamp assembly within the housing.

The lamp housing is a cylindrical enclosure, open at the light output end, for enclosing a lamp socket, a bias spring, a lamp, one or more optional filters, one or more optional spacer rings, a optional diffuser, and a retainer spring. The lamp housing may be formed from high temperature plastic.

The lamp is preferably a sealed beam PAR (parabolic aluminized reflector) lamp, but may be a combination of a halogen lamp, a parabolic reflector and a colored or clear lens disposed over the open end of the reflector lamp. A free floating socket is located at the bottom of the lamp housing to provide electrical connection between the lamp and an external power supply via conventional low voltage wiring or cable that are fed through the base wall of the lamp housing.

A clear or colored lens is disposed at the top of the cylindrical housing. The center portion of the lens may be convex in shape to expand the light beam emitted from the fixture and to deflect water on vertically oriented fixtures. The edge of the lens is flat to fit flush within a shallow recess in the upper surface of the cylindrical housing. The lens is preferably made from glass, but also may be made from polycarbonate, or any other clear or colored transparent/translucent plastic or polymer material.

A C-shaped O-ring is disposed to the outer edge of the lens to form a watertight seal between the lens, the cylindrical housing and a cover. The C-shaped O-ring may be made from silicon, rubber, or any other suitable material that will act as a waterproof seal and is resistant to water.

A cover is attached to the upper end of the housing covering the outer edge of the lens and may include a baffle structure to protect the lens against physical contact. The cover may include light deflecting ridges extending upward to reduce glare in certain directions while permitting efficient transmission of light in the desired direction.

The baffle may be held in place by a plurality of screws disposed to threaded bores in the hollow cylindrical housing upper end. The baffle may alternately be attached by being snapped onto the hollow cylindrical housing upper end or by being screwed onto the hollow cylindrical housing upper end.

The hollow cylindrical housing is preferably made from stainless steel, but may be made from other metals such as brass, aluminum, copper, and the metals may be power-coated or the housing may be formed from polyvinylchloride (PVC), plastic, or other durable, corrosion-resistant, high-impact polymers. The baffle may be formed from the same material as the hollow cylindrical housing or may be formed from brass, anodized or powder-coated aluminum, stainless steel, copper, high impact plastic, or any other material that provides appropriate durability and weather-resistance as well as being aesthetically pleasing.

In the preferred embodiment, the lighting fixture is dimensioned for insertion into a sleeve that is pre-installed with its open end generally flush with the ground or other surface, e.g., pool wall, into which the fixture is recessed. The separate sleeve provides for easy installation and removal of the lighting fixture. In an alternate embodiment, the lighting fixture may be placed directly into the ground, without the sleeve.

Wires for providing power to the fixture are fed through small openings in the side walls or closed end of the sleeve with connectors for attachment to mating connectors extending from the bottom end of the fixture housing. When the housing is removed from the sleeve, the surrounding ground does not have to be disturbed.

BRIEF DESCRIPTION OF THE DRAWINGS

The present invention will be more clearly understood from the following detailed description of the preferred embodiments of the invention and from the attached drawings, in which:

FIG. 7*a* shows the lamp assembly aligned parallel to the axis and off-center axially; FIG. 7*b* shows the lamp assembly mounted at an angle relative to the axis and centered axially; FIG. 7*c* shows the lamp assembly aligned with and centered on the axis; and FIG. 7*d* shows the lamp assembly mounted at an angle relative to the axis and axially off-center.

FIG. 13*a* is a perspective view from the inside side of the rotation retainer/bracket slide, FIG. 13*b* is a perspective view slide adjustment spur retainer and slide adjustment spur, FIG. 13*c* is a perspective view from the outside side of the rotation retainer/bracket slide, and FIG. 13*d* is a top plan view of the rotation retainer/bracket slide.

FIG. 15*a* is a perspective view of the mounting bracket, FIG. 15*b* is perspective view of the rotation spur retainer with spur and FIG. 15*c* is a perspective view of a portion of the alignment blocks and retention columns with spurs.

FIG. 16*a* is side plan view; FIG. 16*b* is a cross sectional view taken along line A-A of FIG. 16*a*; FIG. 16*c* is a cross sectional view taken along line B-B of FIG. 16*b*, and FIG. 16*d* is a side view of the rotation disk.

DETAILED DESCRIPTION OF THE PREFERRED EMBODIMENTS

Figure 1:
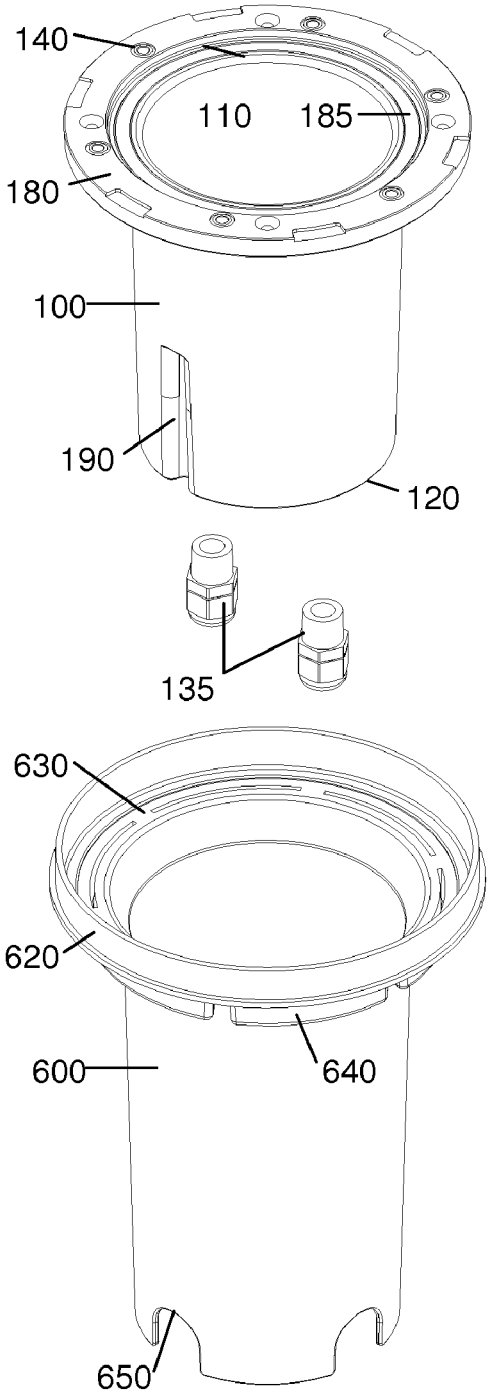
FIG. 1 is an exploded perspective view the light fixture housing and sleeve.
Figure 2A:
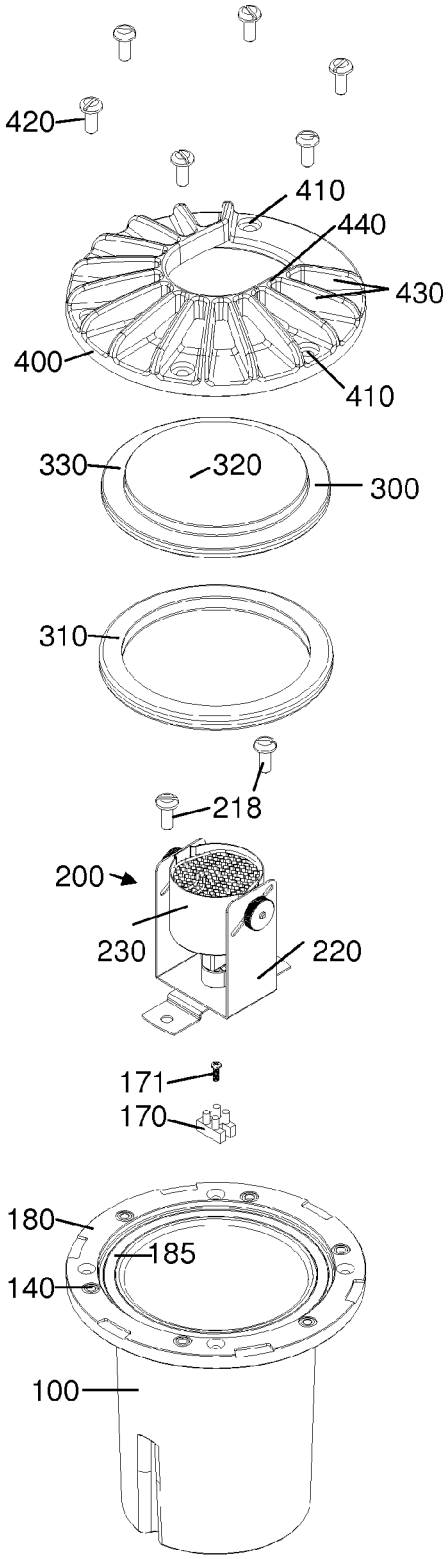
FIG. 2*a* is an exploded perspective view of the in-ground lighting fixture.
Figure 2B:
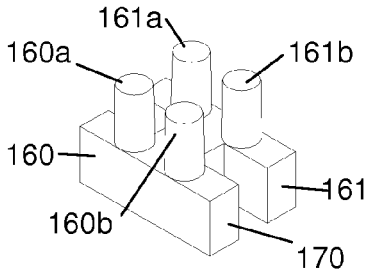
FIG. 2*b* is an enlargement of the electrical connector block.

As illustrated in FIG. 2, a first exemplary embodiment of the in-ground lighting fixture includes cylindrical housing 100, lamp assembly 200, lens 300, and cover 400. The housing 100 is configured to be inserted into a recess, preferably a recess defined by an outer sleeve 600, which is shown in FIG. 1.

Referring to FIG. 2, cylindrical housing 100 has an outlet end 110, a bottom 120, an outer diameter, and an inner diameter. Housing 100 is shorter than outer sleeve 600 so that a cavity 660 is defined at the bottom of the outer sleeve when housing 100 is installed.

Figure 5:
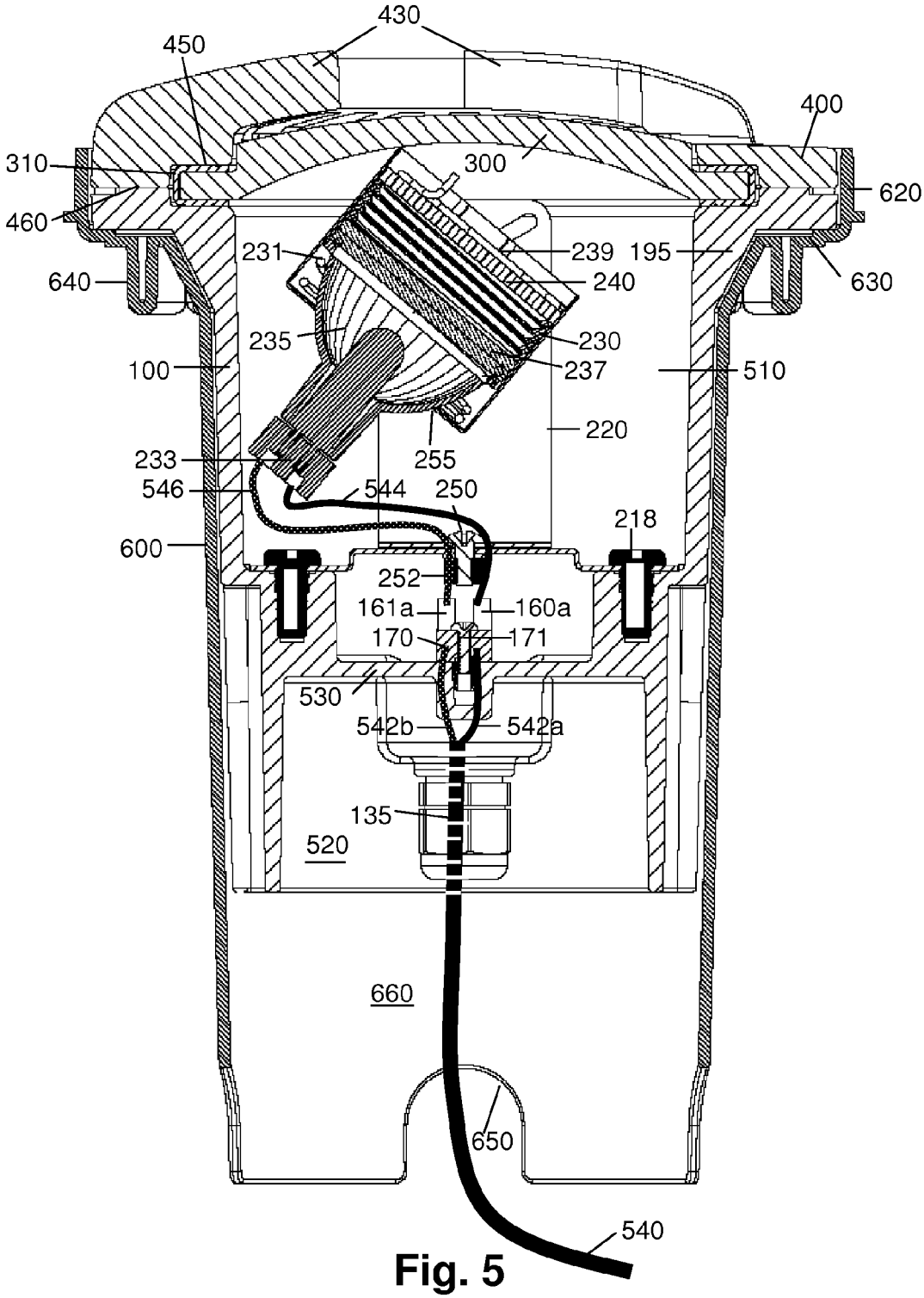
FIG. 5 is a cross-sectional view of the lighting fixture.

Flange 180 extends radially from the outer diameter greater than the outer diameter of housing 100 at the top of the outlet end 110 and has an annular recess 185 for supporting lens 300 and cover 400, and rests on top of support flange 630 if the outer sleeve 600 is used. Recess 185 has a depth that is approximately one-half the thickness of lens 300. A plurality of threaded bores 140 are positioned around flange 180 for attaching cover 400 to housing 100 using mounting screws 420. As illustrated in FIG. 5, a plurality of structural strengthening ridges 195 may be formed integrally with the outer surface of housing 100 and connect to the bottom of the flange 180.

Near the bottom of housing 100, a plurality of vertical grooves 190 are formed to extend a short distance axially from the bottom of the housing. Grooves 190 mate with ribs (not shown) formed on the inner surface of sleeve 600 to prevent housing 100 from rotating once it is fully inserted into the sleeve.

Figure 6:
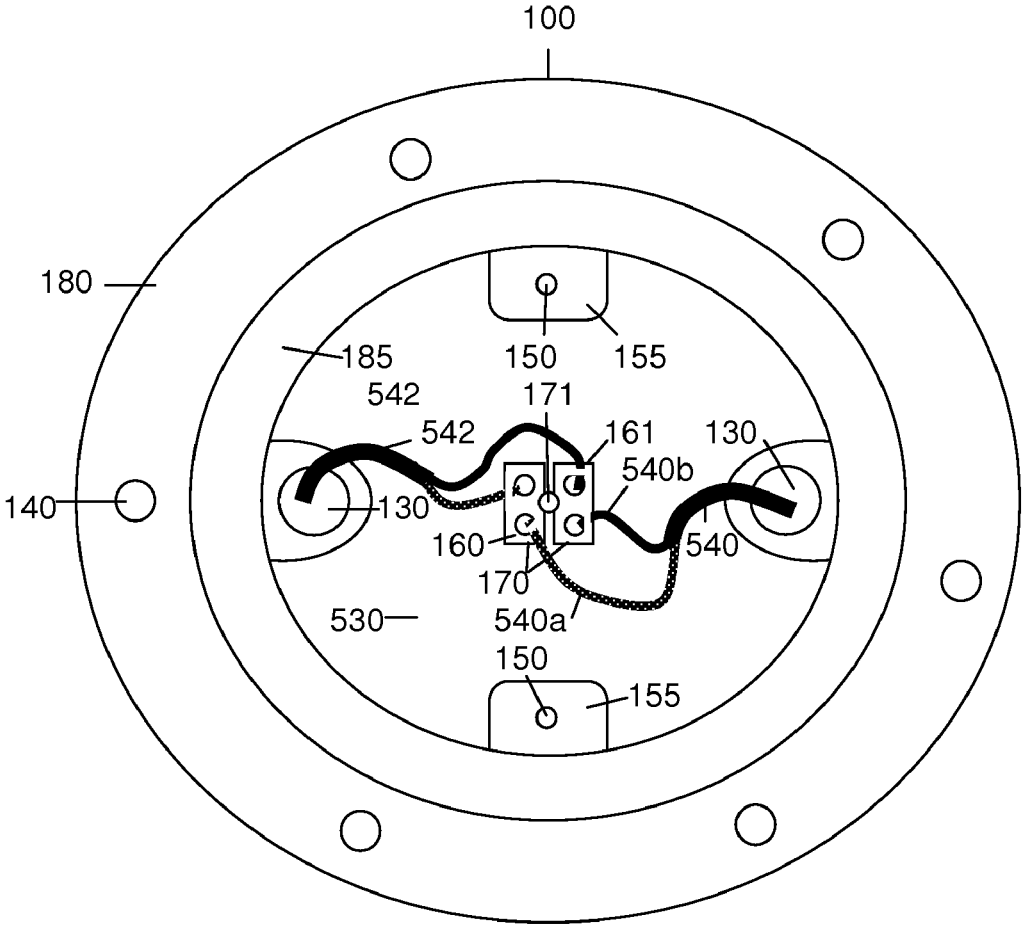
FIG. 6 is a top view of the cylindrical housing.

As shown in FIG. 5, housing 100 has two cavities formed therein. Upper cavity 510 retains the lamp assembly 200 and mounting brackets. Lower cavity 520, open to bottom 120 and separated from upper cavity 510 by partition 530, retains one or more waterproof connectors 135 through which wires are run to provide power from a low voltage source to the fixture. Partition 530 isolates upper cavity 510 from the environment external to the fixture, and cavity 520 helps relieve pressure on the connectors 135 when the fixture is used in an underwater installation. As illustrated in FIG. 6, a threaded opening 130 is formed in partition 530 to receive a matching thread on the upper portion of each waterproof connector 135.

Electrical connector block 170 is attached to the upper surface of partition 530 by means of a screw 171. As shown in FIG. 2*a*, electrical connector block 170 has two sides, 160 and 161 with four contact posts 160*a, b* and 161*a, b*, respectively. Direct burial low voltage cable (shown in FIGS. 5 and 6) containing two wires is cut and the insulation is stripped from each of the cut ends 540 and 542, which are then fed through each connector 135. The wire ends 540*a, b* of cut side 540 are inserted the lower ends of contact posts 160*a* and 161*a*, and the wire ends of the cut side 542 are inserted into the lower ends of contact posts 160*b* and 161*b*. As shown in FIG. 5, one or both contact posts of side 160 are attached to one wire 544 that is connected to one contact on the bottom side of lamp socket 233, while the posts of side 161 are attached to a second wire 546 connected to the other contact on the bottom side of socket 233. Note that wires 544 and 546 should be of sufficient length to permit the full range of movement of the lamp assembly without undue strain on the connections. The use of electrical connector block 170 allows the wires from socket 233 to be disconnected for easy removal of the lamp assembly 200 when repairs or adjustments are required.

Two support seats 155 are formed on opposite sides along the inner side walls of the hollow cylinder housing 100 and extend upward a short distance from the upper surface of partition 530. The base bracket 210 is disposed on top of the support seats and base screws 218 are inserted through base holes 215 into threaded mounting holes 150 in support seats 155.

Housing 100 may be formed from polyvinylchloride (PVC), polymer, plastic or similar materials that are resistant to corrosion and oxidation. In the preferred embodiment, housing 100 is injection molded from a thermoplastic polyester resin such a Valox®.

FIG. 1 illustrates outer sleeve 600, which may be optionally used to facilitate installation and removal of the fixture from the mounting surface. The outer sleeve 600 is hollow cylindrical shaped, slightly larger in diameter and depth than the hollow cylindrical housing 100, and is designed so the hollow cylindrical housing 100 slides into the outer sleeve 600. The upper end of the outer sleeve 600 forms a support flange 630 with a raised side wall 620. The flange 180 of the hollow cylindrical housing 100 is retained within the recessed surface of support flange 630 when housing 100 is inserted into outer sleeve 600. The annular side wall 620 extends from support flange 630 and has a height approximately equal to the combined thicknesses of flange 180 and cover 400. A plurality of ribs (not shown) formed on the inner surface of outer sleeve 600 slidably mate with corresponding grooves 190 that are formed in the bottom of housing 100 to stabilize housing 100 against rotation once it is inserted into sleeve 600.

For installation of the lighting fixture, a recess with a depth corresponding to the length of sleeve 600 is formed in the surface within which the fixture is to be recessed. For in-ground installation, a hole is dug into the ground. For in wall installation, or for installation into concrete or other construction material, the recess is preferably formed when the material is originally constructed, or may be cut or drilled as appropriate for the material. The sleeve 600 is then placed into the recess. The cut-outs 650 in the bottom of sleeve 600 provide means for feeding the low voltage cable into the sleeve for connecting the fixture to a power supply. When it is necessary to adjust or replace the lamp 235, or to replace the lens 300 or filters 237, the lighting fixture is easily removed from sleeve 600 without requiring digging or physical damage to the surrounding structure.

Sleeve 600 may be formed from polyvinylchloride (PVC), polymer, plastic, or a metal such as anodized or powder-coated aluminum, brass, copper, or stainless steel, or other similar materials that are resistant to corrosion and/or oxidation. In the preferred embodiment, the outer sleeve 600 is injection molded from a high-impact plastic or a thermoplastic polyester resin such a Valox®.

Figure 3:
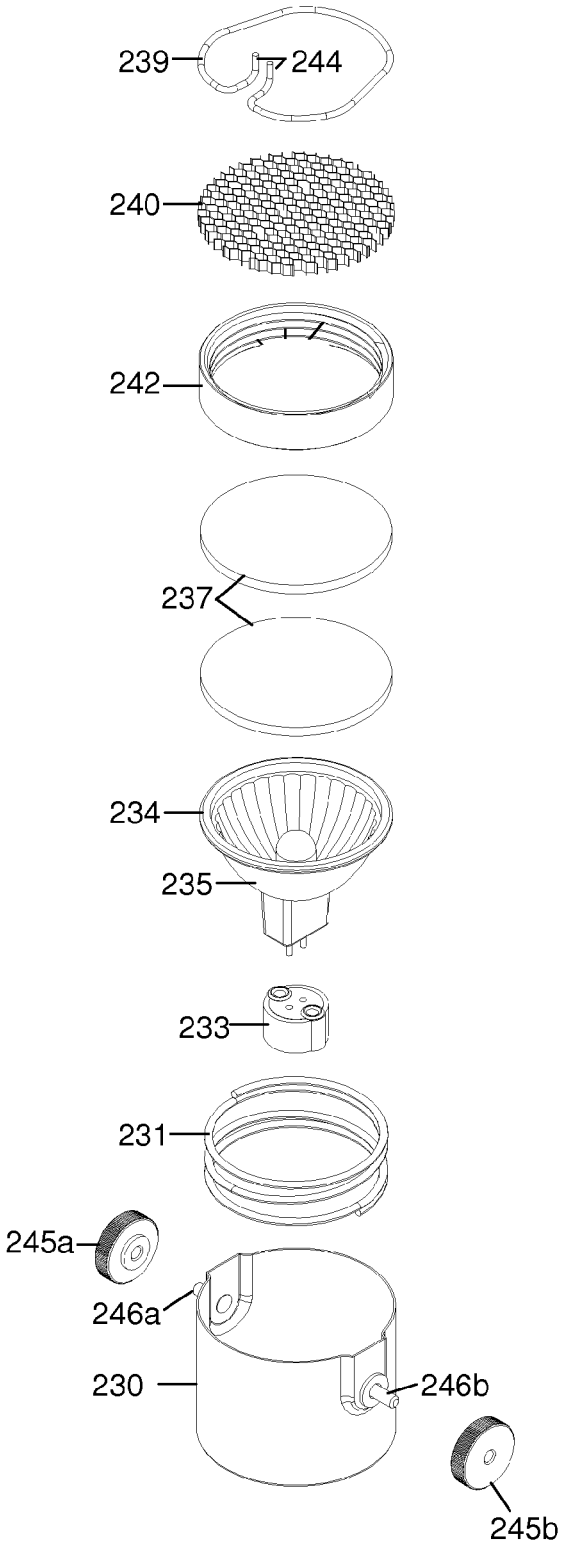
FIG. 3 is an exploded perspective view of the components within the lamp assembly.
Figure 4:
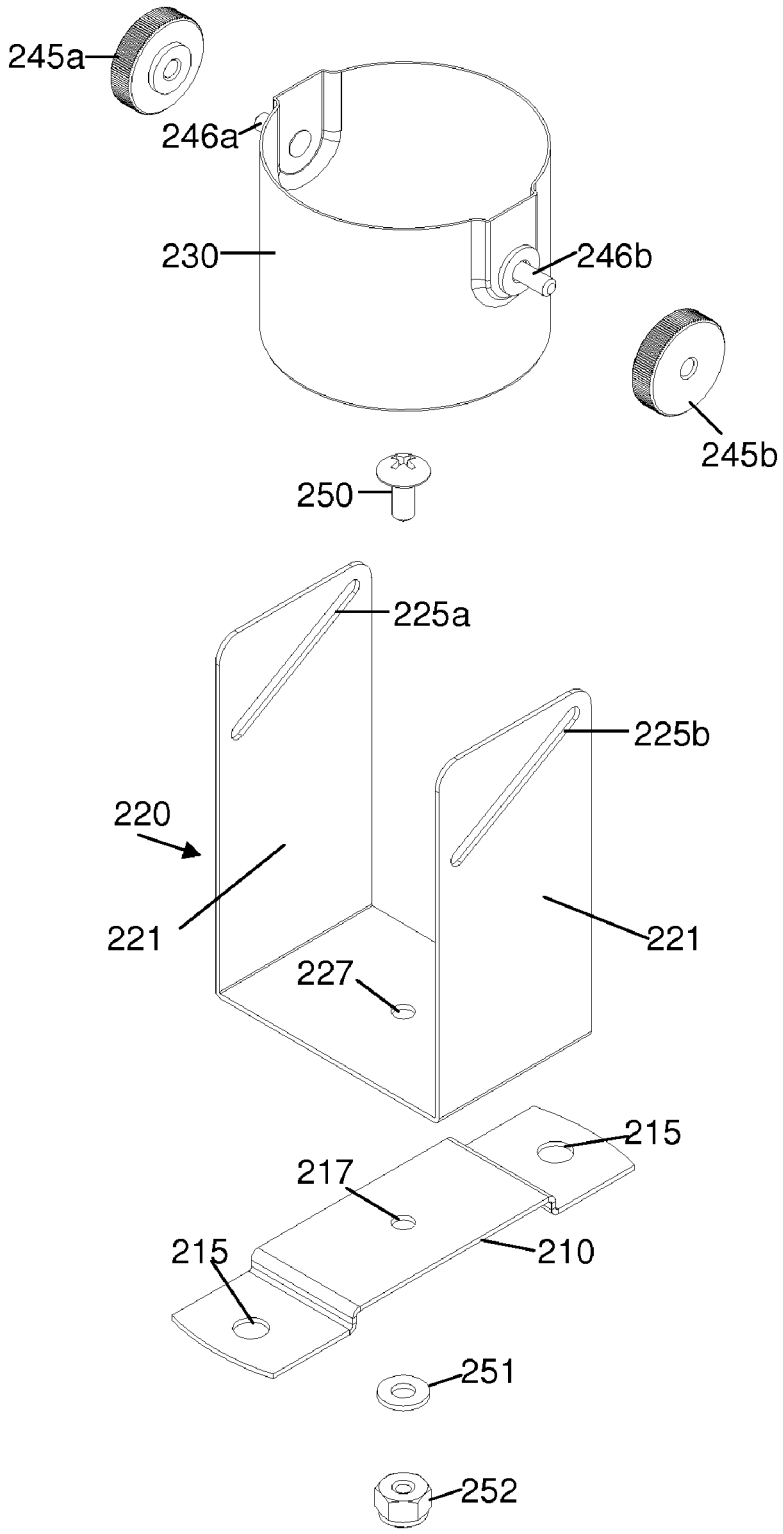
FIG. 4 is an exploded perspective view of the mounting components of the lamp assembly.

Illustrated in FIGS. 3-5, lamp assembly 200 comprises base bracket 210, U-shaped bracket 220, a lamp housing 230, two thumb nuts 245*a* & *b* with two bolts 246, bias spring 231, socket 233, lamp 235, one or more filters 237, one or more spacer rings 242, diffuser 240, and retainer spring 239.

The lamp housing 230 is a generally cylindrical enclosure with an open top and a bottom end. The bottom end has a central opening 255 through which the base of lamp 235 extends. Threaded pivots 246*a* and 246*b* are inserted through openings through the sides of lamp housing 230 and slots 225*a,b* on bracket 220 to provide a pivot point. Thumb nuts 245*a,b* are screwed onto bolts 246*a,b*, respectively, and are tightened to hold the pivot angle and height of the lamp housing 230 after the desired adjustments have been made. While slots 225*a,b* may extend longitudinally along arms 221 of bracket 220, they are preferably oriented in an angular arrangement that effectively provides a combination of vertical and lateral adjustment of the lamp housing position relative to bracket 220.

Referring to FIG. 4, bracket 220 is rotatably attached to base bracket 210 by inserting screw 250 through hole 227 in bracket 220 and hole 217 in the base bracket. A washer 251 and a lock nut 252 are place over the end of screw 250 to permit pivoting of bracket 220 relative to bracket 210 to provide an additional axis of adjustment of the lamp housing. As previously described, base bracket 210 is attached to the support seats 155 of housing 100.

The combination of the rotation of the U-shaped bracket 220 and the pivoting of lamp housing 230 allows the beam of light emitted from the lamp to be adjusted across a wide range along each of at least three axes—tilt angle ($\phi$ or zenith in a spherical coordinate system), rotational angle ($\theta$ or azimuth in a spherical or cylindrical coordinate system), longitudinal depth (h or height in a cylindrical coordinate system), limited only by the bounds of housing 100. Additional range of motion is provided along the radius, or r coordinate of a spherical coordinate system, due the angular orientation of slots 225*a,b*.

Figure 7A:
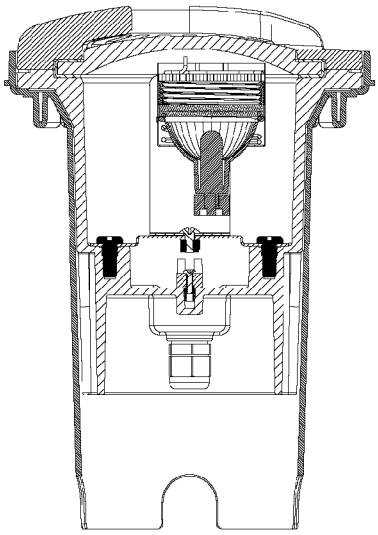
FIGS. 7*a-d* are cross-sectional views of the lighting fixture where
Figure 7B:
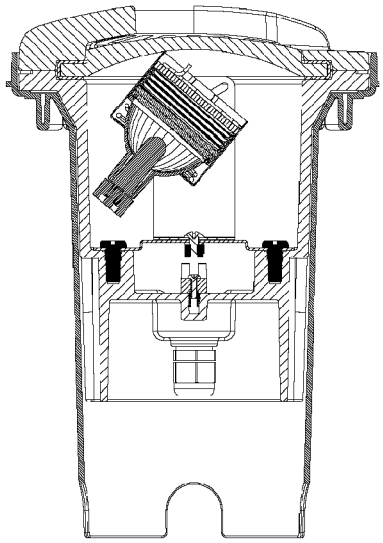
Figure 7C:
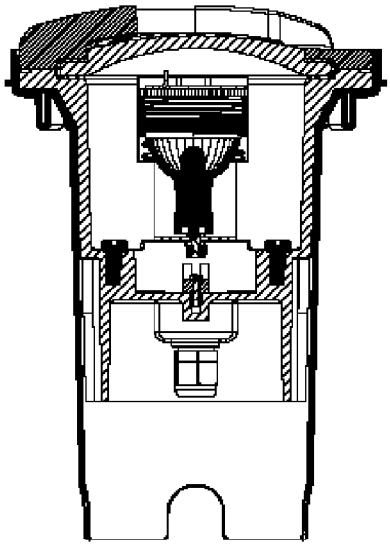
Figure 7D:
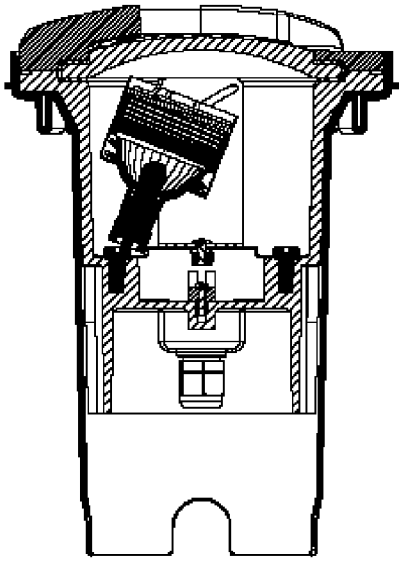

FIGS. 7*a-d* provide a few examples of many different possible adjustments that may be made for adapting the character of the emitted light to the specific application. FIG. 7*a* shows the lamp assembly aligned parallel to the axis and off-center axially. FIG. 7*b* shows the lamp assembly mounted at an angle relative to the longitudinal axis of the housing and centered axially. FIG. 7*c* shows the lamp assembly aligned with and centered on the longitudinal axis of the housing. FIG. 7*d* shows the lamp assembly mounted at an angle relative to the axis and axially off-center.

In the preferred embodiment, the lamp housing 230 is formed from high temperature plastic, polymer, or thermoplastic polyester resin, preferably formed by injection molding. If greater flexibility is desired, the lamp housing 230 may be made of Nylon® or other appropriate material.

Spring 231 is disposed between the underside of lip 234 of lamp 235 and the bottom of lamp housing 230 to bias the lamp outward away from the bottom of housing 230. The outer diameter of spring 231 is slightly smaller than the inner diameter of lamp housing 230.

Lamp 235 is a commercially available lamp with a generally parabolic reflector. In the preferred embodiment, the lamp is a sealed PAR (parabolic aluminized reflector) lamp with a halogen tube or incandescent filament. Alternatively, an open reflector type lamp, such as a MR-16 halogen lamp, may be used. Lamp 235 is plugged into commercially available socket 233 which is connected via wires (not shown) to connector 170. The wires should be of sufficient length to allow lamp housing 230 to be moved through its full range of angle and height adjustments.

Referring to FIG. 3, filters 237, which have diameters similar to the diameter of the rim of lamp 235 are disposed on top of lamp 235, typically with the lower-most filter pressed against the top of lamps 235. The filters may be clear or colored, and different combinations of filters may be used to create different effects. The filters are preferably made from glass or a temperature-resistant plastic such as Lexan® (polycarbonate). One or more spacers, such as the Recessor Ring® spacer 242 that is the subject of U.S. Pat. No. 6,612,720, which is incorporated herein by reference, may be utilized to permit creation of a variety of different lighting effects. Briefly, different filters (diffusers and colored filters 237) may be combined, and baffles 240 can be included in conjunction with variation of the longitudinal recess depth of the lamp within lamp housing by using a RECESSORRING® 242 spacer. The spacers and various combinations of filters and other optical elements are fully described in U.S. Pat. No. 6,612,720, and a complete description need not be repeated here. Retainer spring 239 is used to hold filter(s) 237, spacer (s) 242, and lamp 235 in place as they are pushed outward by bias spring 231.

Referring to FIG. 2*a*, lens 300 has an outer diameter larger than the inner diameter of housing 100. The center of lens 300 is preferably convex, while the circumferential edge of the lens defines a flange 330 that fits flush within shallow recess 185 formed along the inner diameter in the upper flange 180 of housing 100. Lens 300 is preferably made of clear glass, but may be formed from a high temperature plastic or polymer such as Lexan®, Makrolon® or Zelux® (polycarbonate) and may be colored, textured, or clear in order to achieve a desired lighting effect.

A C-shaped O-ring 310 is disposed over the outer edge of lens 300 to form a water tight seal between lens 300, flange 180 and cover 400. The C-shaped O-ring may be made from silicone, rubber, or any other suitable elastomeric material that is capable of producing a watertight seal.

Illustrated in FIGS. 2*a* and 5, cover 400 is circular in shape and has an outer diameter that fits within the upper edge of housing 600, i.e., is dimensioned similar to the outer diameter of flange 180. Cover 400 has a lower flat surface 460 that fits over and covers flange 180 and the flat portion 330 of lens 300. A recess 450 is formed in the underside of cover 400 to fit over the outer diameter of lens 300 so that lower flat surface 460 abuts the top of flange 180. The depth of recess 450 is approximately one-half the thickness of lens 300 so that the portion of lens 300 that extends above the plane defined by the upper surface of flange 180 fits closely within recess 450. Cover 400 covers the entire C-shaped O-ring 310 so that when screws 420 are tightened, cover 400 compresses O-ring 310 to form a watertight seal.

Illustrated in FIGS. 2 and 5, cover 400 has ridges 430 that extend upward to protect lens 300, and to partially deflect the emitted light. A U-shaped opening 440 near the center allows a greater amount of light to exit in the direction of the open end of the U-shape. Typically, the rotational position of the lamp assembly and the U-shaped opening 440 are aligned so that the light is essentially unimpeded in the direction of the "U". Alternatively, cover 400 may be simply a ring with a fully light transmissive center, which may include a cowling extending upward from the outer diameter of the ring. Further details of the cover 400 will be apparent by viewing the drawings of U.S. Design Pat. No. D573,297, which is incorporated herein by reference in its entirety.

Cover 400 may be formed from a high-impact, injection molded plastic or thermoplastic polyester resin such as Valox®, but may also be made of a metal such as copper, brass, anodized aluminum, powder-coated aluminum or steel, or other suitable material.

For installation of the lighting fixture into the ground, sleeve 600 and the sleeve is placed into a hole dug in the ground. For installation in a paved area or in a vertical wall such as in a pool, a circular opening is preferably molded prior to pouring the cement or other surfacing material. Alternatively, an appropriate hole may be cut into an existing surface. Access to the lamp assembly for adjustment or replacement after installation is achieved by unscrewing screws 420 to lift off cover 400 and lens 300.

Figure 17A:
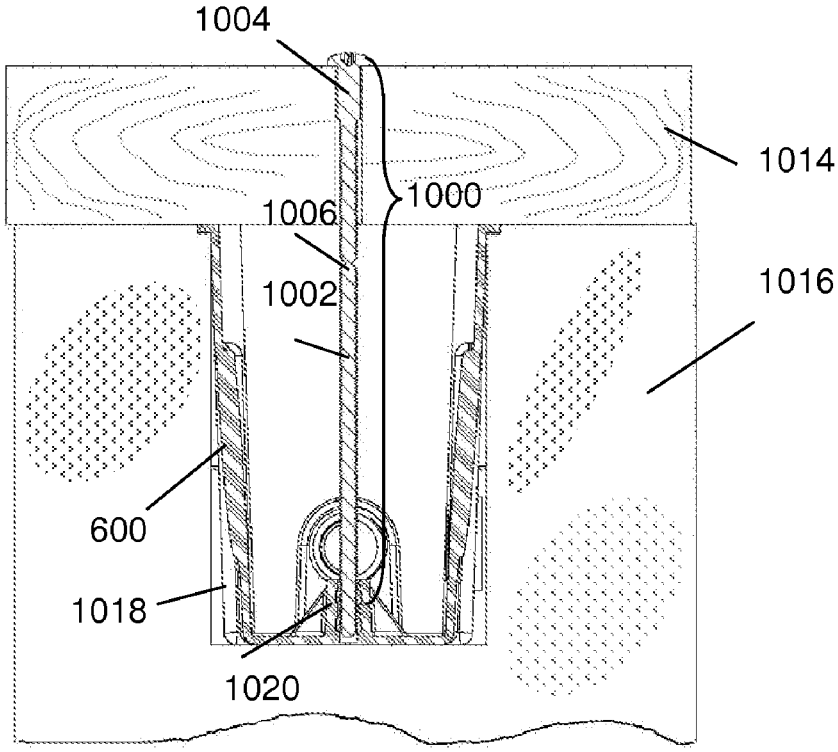
FIG. 17*a* is a diagrammatic cross-sectional view showing an installation of an alternative embodiment of the outer sleeve in a structure.
Figure 17B:
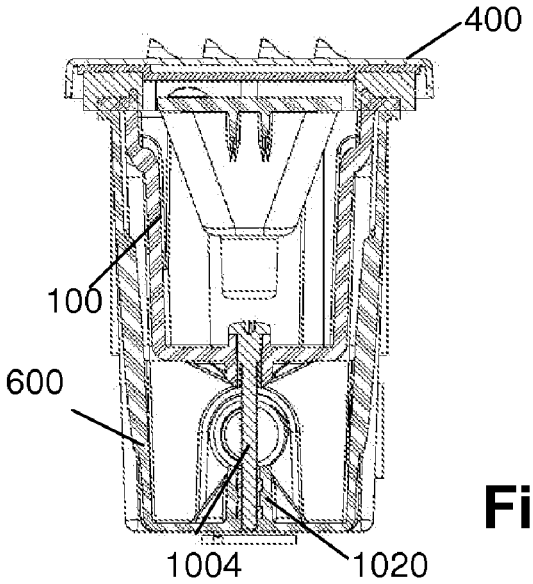
FIG. 17*b* is a cross-sectional view of the fixture positioned within the outer sleeve of the alternative embodiment.

FIGS. 17*a* and 17*b* illustrate an alternative embodiment of the sleeve 600 that is slightly modified to facilitate installation into a constructed block structure, such as a concrete slab or the wall of a pool, that is formed by creating a mold and pouring cement into the mold. A screw 1000 is of sufficient length to extend through the full depth of sleeve 600 and through the thickness of mold 1014 (only the face portion of a wood mold is shown.) The screw is inserted through an opening in mold 1014, and screwed into a threaded opening in a boss 1020 that is located on the inside bottom of sleeve 600. Boss 1020 is integral formed with the sleeve, preferably during the molding process. The screw 1000 holds the sleeve 600 firmly against the mold 1014 so that the cement 1016 or other building material can be poured into the mold and around the sleeve without loss of the desired alignment. This also ensures that the sleeve 600 is flush with the face of the structure in which it is located. Conduits (not shown) will also be included in the structure being formed to provide means for linking the fixture retained in the sleeve to a voltage source.

Screw 1000 is configured in two sections, upper section 1004 and lower section 1002, with the two sections separated by a joint 1006 that has a reduced diameter. After the building material is set, the mold 1014 is removed. Screw 1000 may be unscrewed to allow removal of the mold, of the mold can be moved in a way that creates a shear force that breaks the screw at joint 1006. The lower section 1002 is unscrewed from boss 1020 and the upper section 1004 can be used to affix the fixture to the sleeve by inserting the screw 1004 through an opening in the bottom of housing 100, as shown in FIG. 17*b*.

It should be noted that while the housing will usually be cylindrical for ease of manufacture and installation, the shape of the baffle is not so limited, and different geometric shapes, e.g., square, pentagonal, hexagonal, etc., may be utilized to achieve a particular aesthetic effect.

A second embodiment of the light fixture, illustrated in FIGS. 8-16, incorporates most of the same elements as the first embodiment, with the key difference being the lamp assembly. Lamp assembly 700 includes lamp housing 701, lamp housing bracket 800, rotation retainer/bracket slides 880 (connectors), and mounting bracket 900.

Figure 8:
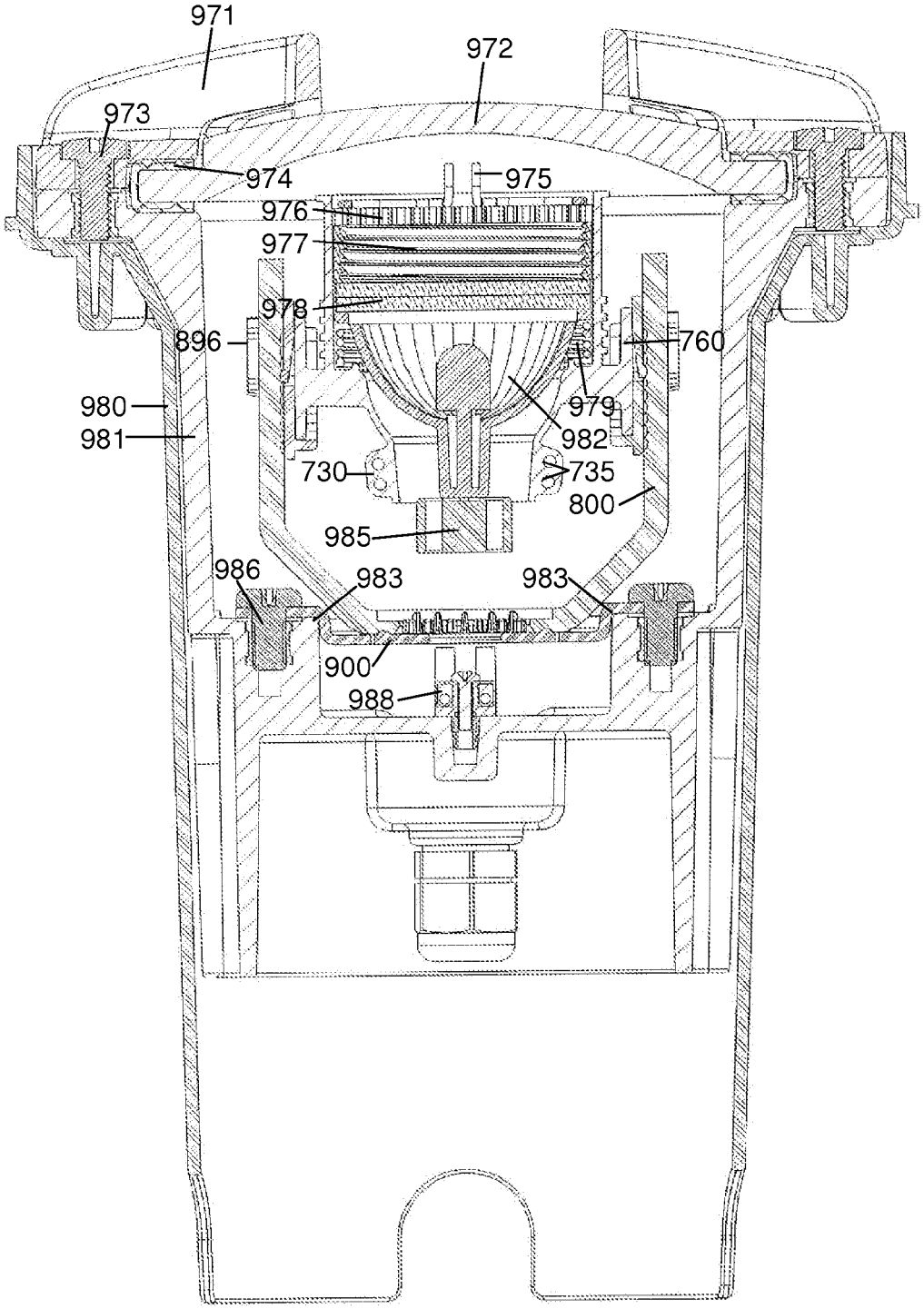
FIG. 8 is a cross sectional view of a second embodiment of the in-ground lighting fixture.
Figure 9:
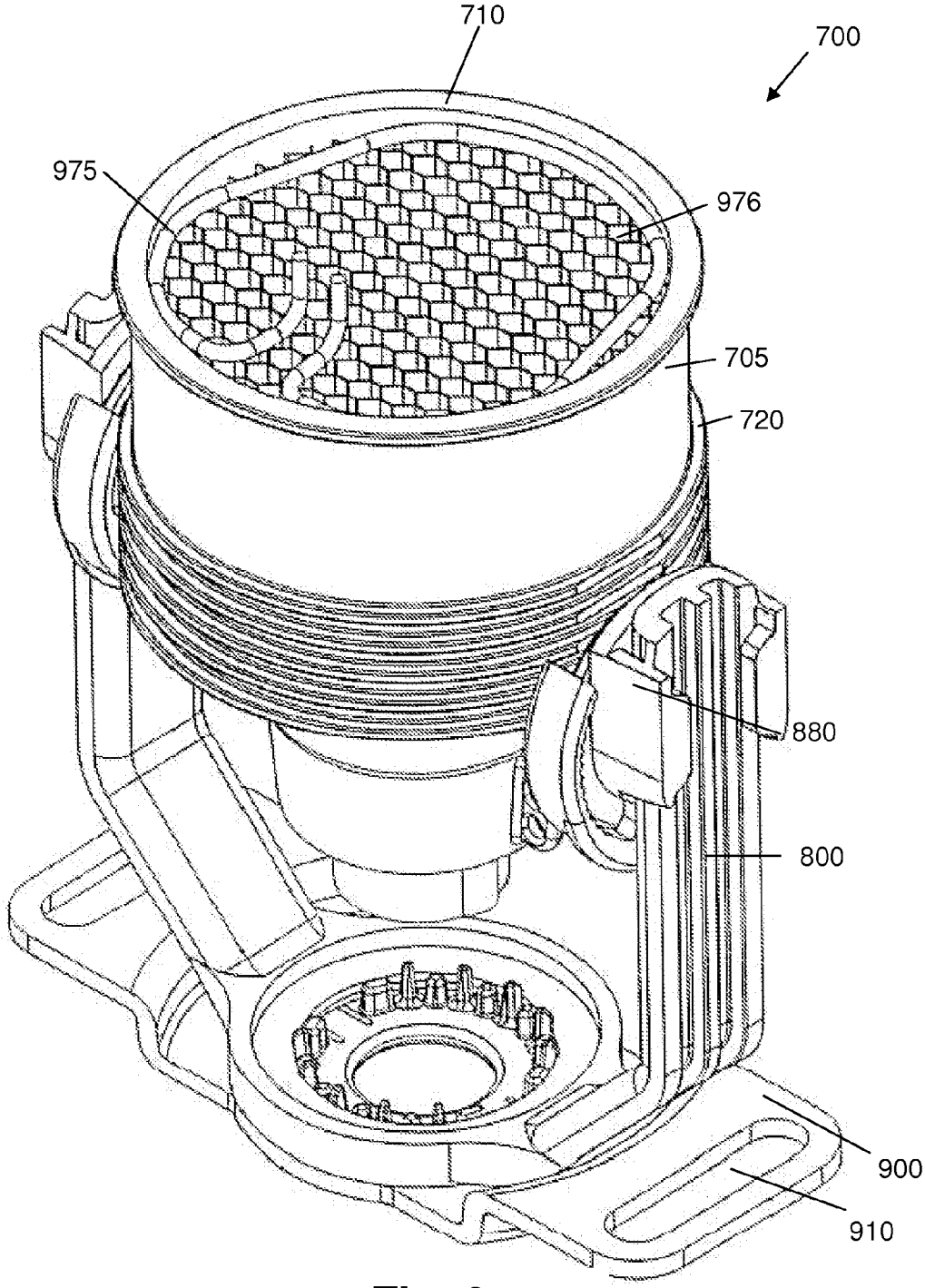
FIG. 9 is a perspective view of a second embodiment of the lamp assembly with lamp housing bracket and mounting bracket.
Figure 10:
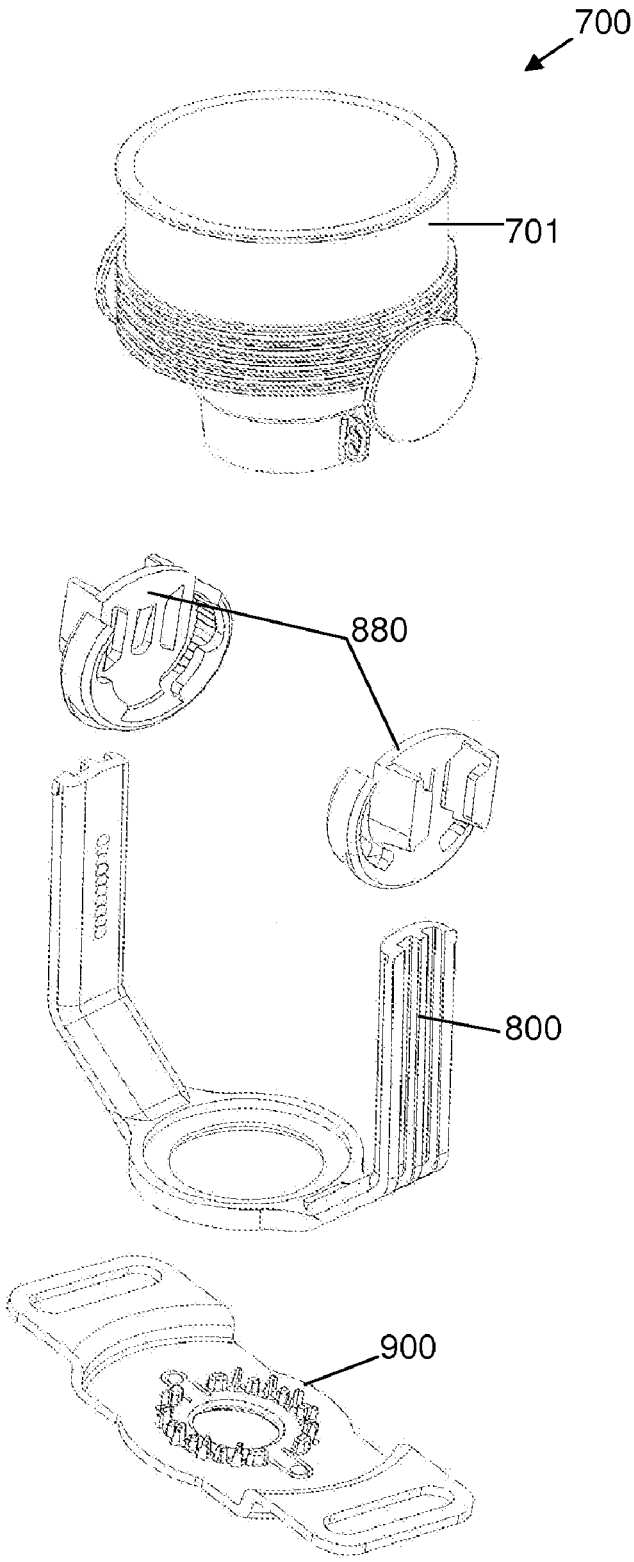
FIG. 10 is an exploded perspective view of a second embodiment of the lamp housing and brackets.

FIG. 8 illustrates the components within the lamp housing 701 including retainer spring 975, spacer(s) 977, filter(s) 978, lamp 982, and bias spring 979. As in the first embodiment, housing 981 slides in place into sleeve 980. Cover 971 is attached by screws 973 to housing 981. O-ring 974 creates a watertight seal between lens 972, cover 971 and housing 981. Lamp housing 701 pivotally attaches to rotation retainer/bracket slide 880, which in turn slidably attaches to lamp housing bracket 800. Lamp housing bracket 800 rotatably attaches to mounting bracket 900 which is attached to the housing by screws 986. Electrical connection for lamp 982 is made via electrical wires (not shown) connecting the socket 985 to the electrical connector block 988, and electrical wires (not shown) making electrical connection to an external power supply.

Features of lamp housing 701 are illustrated in FIGS. 9 through 12 and FIGS. 16*a*-16*c*. Lamp housing body 705 is cylindrical in shape with an open top end 704 and a bottom end 706. Flange 710 extends radially outward from top end 704 of lamp housing body 705 to provide additional rigidity to maintain the circular shape of the housing. Near the longitudinal center of lamp housing body 705, a plurality of annular ribs 720 extend radially outward from the from the body wall to provide additional rigidity as well as providing a gripping surface to facilitate handling during adjustment. The lower end 706 of lamp housing body 705 has a tapered section 703 to roughly conform to the base of lamp 982. Tapered section 703 has an opening 708 at its lower end for providing access for connection of lamp 982 and socket 985. Extending from just below taper 703 are strain relief tabs 730 with holes 735. The wires (not shown) for connection to lamp socket 985 are inserted through holes 735 prior to connection to electrical connector block 988 to help prevent damage to the connection during positioning of the lamp assembly.

As in the prior embodiment, the lamp housing 701 may be formed from high temperature plastic, polymer, or thermoplastic polyester resin, preferably formed by injection molding. If greater flexibility is needed, the lamp housing 701 may be made of Nylon® or other appropriate material.

Figure 11:
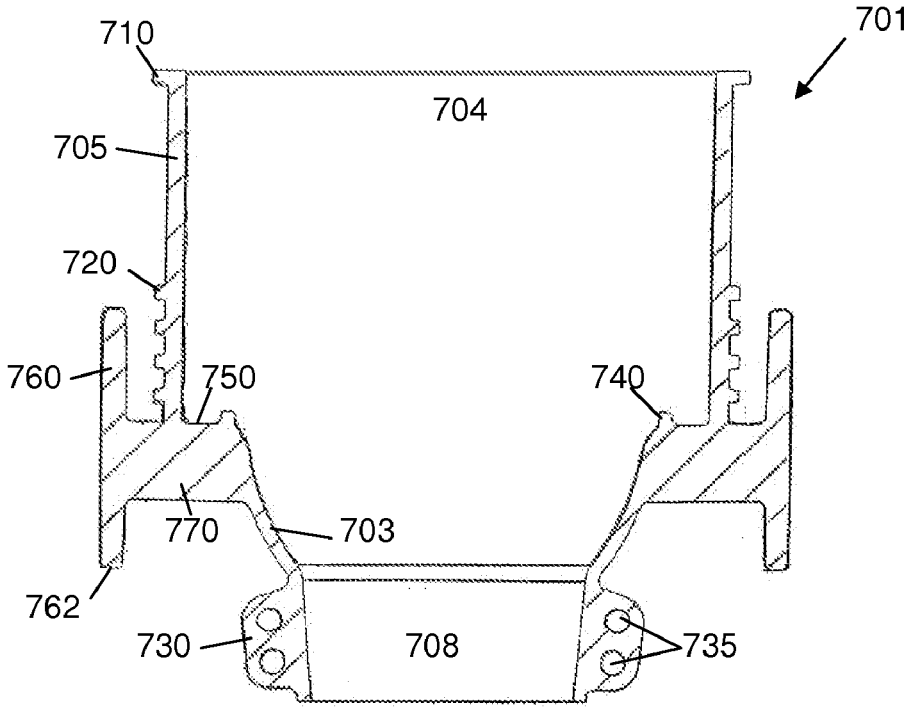
FIG. 11 is a cross-sectional view of a second embodiment of the lamp housing.
Figure 16A:
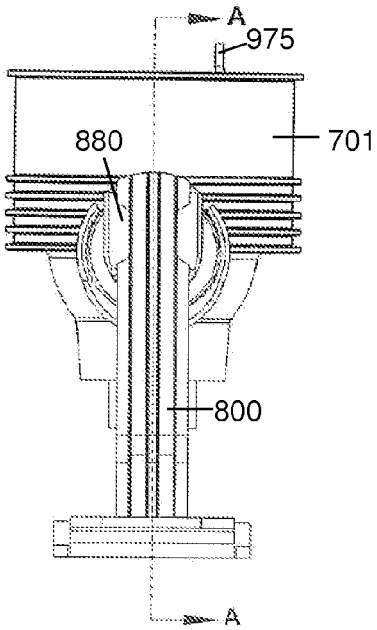
FIGS. 16*a*-16*d* illustrate the lamp housing assembly of the second embodiment where
Figure 16B:
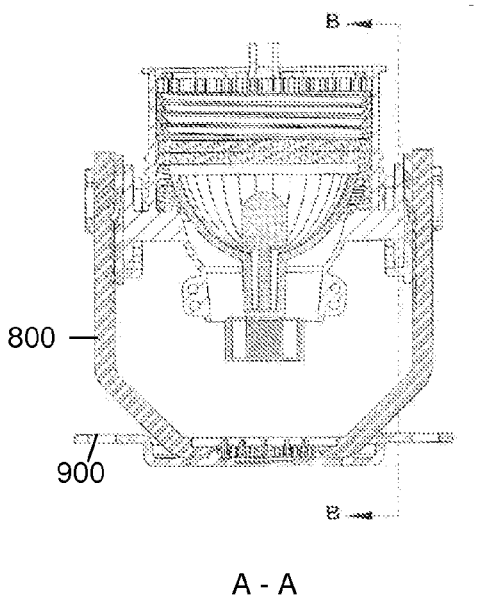
Figure 16C:
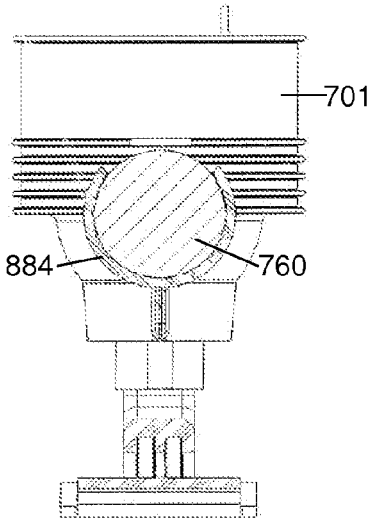
Figure 16D:
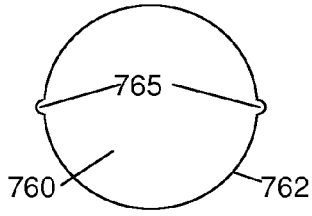

Referring to FIG. 11, two disk supports 770 extend from opposite sides of lamp housing body 705 and terminate at rotation disks 760 to define the pivot axis for tilting housing body 705. Rotation disks 760 and disk supports 770 are preferably formed integrally with body 706 during the injection molding or machining process. Rotation disks 760 are generally circular with one or more small tabs 765 extending radially therefrom, as illustrated in FIG. 16*d*. Rotation disk 760 allows the lamp housing 701 to be tilted at least 40 degrees in either direction in order to make declination adjustments to the direction of the light beam. Rotation tab 765 slips into ratcheting ridges 882, illustrated in FIG. 13*c*, to hold the position of lamp housing 701.

Figure 12:
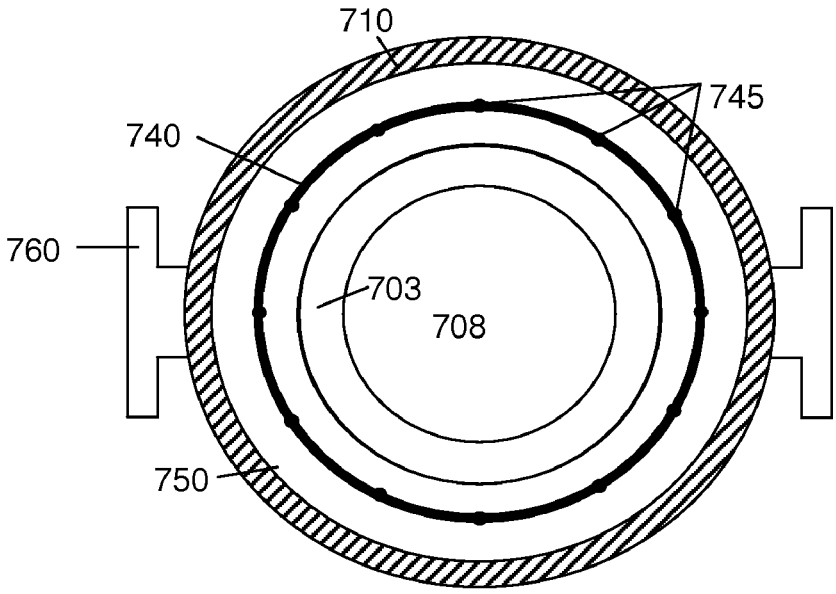
FIG. 12 is a top plan view of a second embodiment of the lamp housing.

Referring to in FIGS. 11 and 12, spring centering ring 740 extends upward from ring 750 to support spring 979. Ribs 745 may be provided to give additional strength to the centering ring.

Figure 13A:
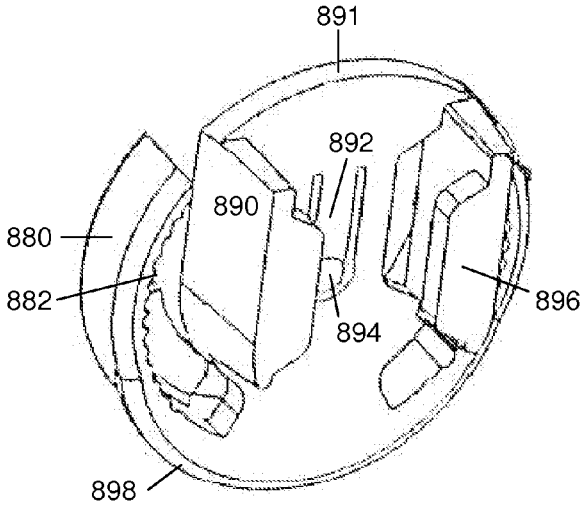
FIGS. 13*a*-13*d* illustrate the rotation retainer/bracket slide of the second embodiment where
Figure 13B:
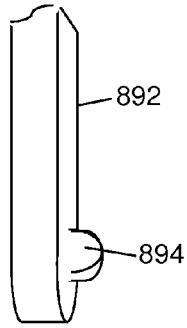
Figure 13C:
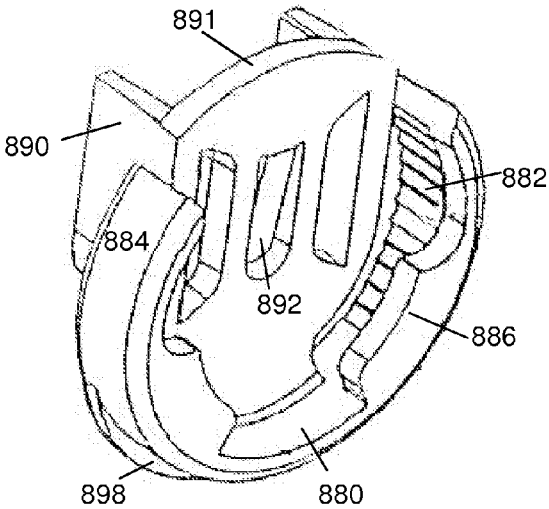
Figure 13D:
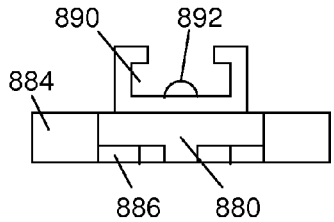

Referring to FIGS. 13*a*-13*d*, rotation retainer/bracket slide 880 is generally circular in shape with its outer side shown in FIG. 13*a*, and its inner side shown in FIG. 13*c*. Rotation retainer/bracket slide 880 is dimensioned to receive rotation disk 760 on the inner side, while the outer side fits over lamp housing bracket 800.

The inner side of rotation retainer/bracket slide 880 defines a partially disk shaped cavity 884 with an open upper end, i.e., "C"-shaped, to permit insertion rotation disk 760. The open upper end is slightly smaller than the diameter of disk 760 so that pressing the disk 760 against the opening forces the opening to enlarge ad then resume its shape once the disk is fully inserted. Radial extensions 886 on the edge of cavity 884 provide lateral support to keep disk 760 within the cavity.

Ratchet ridges 882 are formed on the inner surface of cavity 884. Ridges 882 cooperate with rotation tabs 765 to provide a ratcheting function of retainer the rotational positions of the disk 760 until sufficient rotational force is applied to overcome the resistance created by the ridges 882. The ratcheting ridges 882 may extend around the entire inner surface of cavity 884 or only portions of it, as illustrated in FIG. 13*c*.

The outer side of rotation retainer/bracket slide 880 defines a channel 890 that fits over arm 830 of bracket 800. As shown in profile in FIG. 13*d*, channel 890 is partially open on its outer side.

Formed in the center of the bracket slide retainer back plate 891 is the slide adjustment spur retainer 892. The slide adjustment spur 892 formed at the center of channel 890 is notched at its proximal end to create an outward bias at the distal end where bump 894 projects outward to engage dimples 820 on the inner surface of arm 830. the cooperation between bump 894 and dimples 820 maintain the location of rotation retainer/bracket slide 880, and in turn, the lamp housing.

Figure 14A:
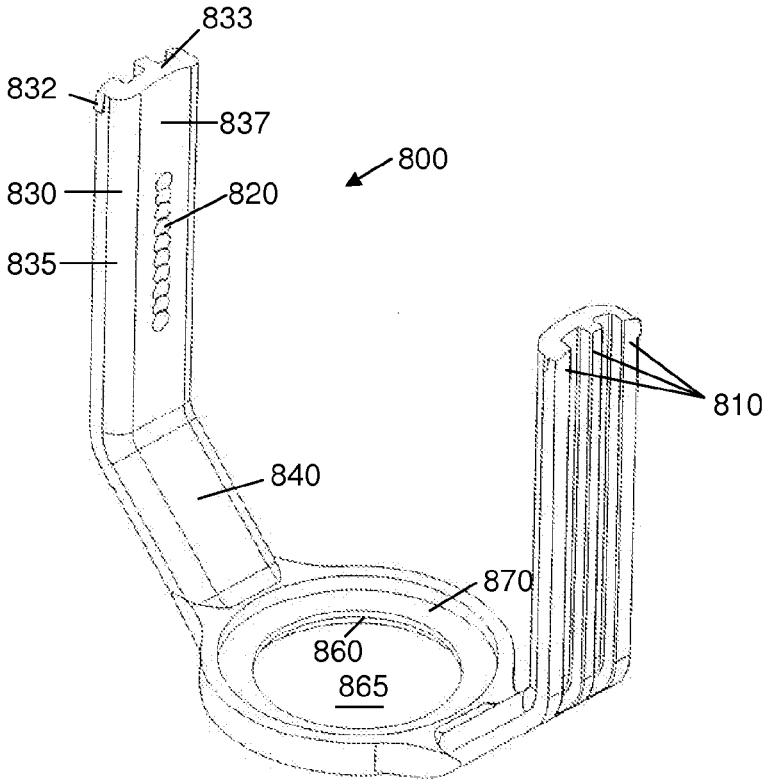
FIGS. 14*a*-14*b* are a top perspective view and a bottom perspective view, respectively, of the lamp housing bracket.
Figure 14B:
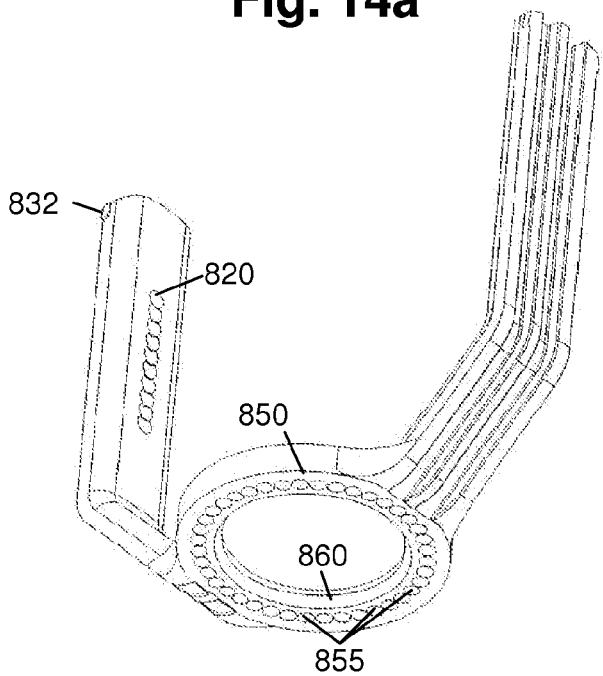

As illustrated in FIGS. 14*a* and 14*b*, lamp housing bracket 800 is generally U-shaped with two bracket arms 830 and bottom portion 870. Bracket arms 830 have an inner surface 837, an outer surface, two side surfaces, an upper end 833, angled lower portion 840, and a vertical portion 835. The upper end 833 of each bracket arm 830 is rounded to facilitate sliding of channel 890 onto the arm. A stop 832 extends from the edge near upper end 833 to resist removal of rotation retainer/bracket slide 880 from bracket arm 890. A plurality of strengthening ribs 810 are formed on the outer surface of the bracket arm 830, extending the full length of the arm. A series of dimples 820 are formed in a line on the inner surface 839 in the center of each bracket arm 830 to cooperate with tab 894 to hold rotation retainer/bracket slide 880 in place. The rotation retainer/bracket slide 880 has at least one inch of travel along the bracket arm 830.

The bottom of the lamp housing bracket 800 is circular in shape and an upper surface and a lower surface. A beveled opening 860 is formed in the radial center of the lower surface of lamp housing bracket 800 to center it with bracket 900. A plurality of rotation adjustment dimples 855 ring the beveled opening 860. An annular recess is formed in the upper surface of bracket bottom 870.

The lamp housing bracket 800 may be made of a high temperature polymer, a nylon compound and is preferably injection molded. Alternatively, bracket 800 may be made of a suitable metal.

Figure 15A:
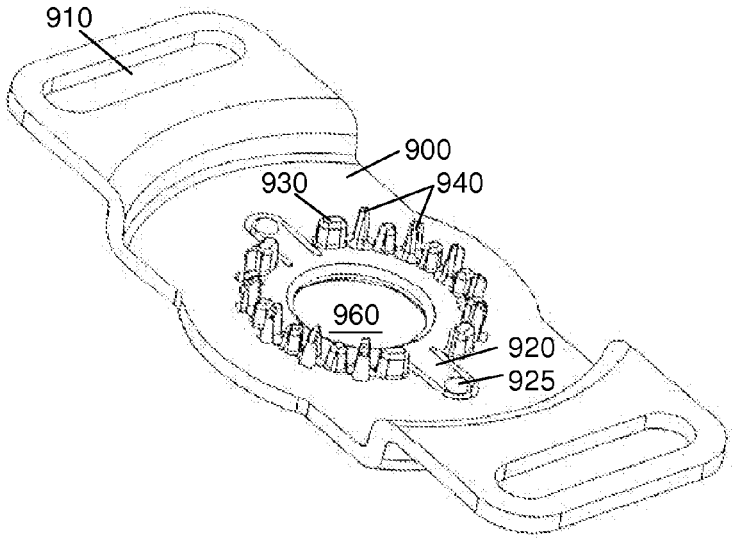
FIG. 15*a*-15*c* illustrate the mounting bracket of the second embodiment where
Figure 15B:
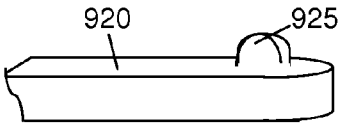
Figure 15C:
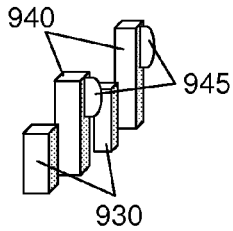

As illustrated in FIGS. 15*a-c*, mounting bracket 900, is generally rectangular in shape with rounded corners, two raised end sections, a center section with an opening 960 at its radial center, a bottom surface, and an upper surface. The profile of bracket 900 conforms with the molded inner bottom profile of housing 981, with the end sections being supported on annular seat 983. Elongated mounting slots 910 are formed near the edges of the end sections for insertion of fastening screws 986 into threaded opening in seat 983. The elongated slots 910 allow bracket 900 to be adjusted relative to the center axis of housing 981.

The upper surface of the center section of mounting bracket 900 is illustrated in FIG. 15*a*. Central opening 960 serves as a pass-through for wires (not shown) between connector 988 and socket 985. A plurality of alternating alignment blocks 930 and retention columns 940 with spurs form a resilient ring of a diameter slightly larger than center opening 960. As shown in FIG. 5*c*, spurs 945 extend radially outward from retention columns 940. Beveled opening 860 of bracket 800 fits closely around the ring formed by the combination of alignment blocks 930 and retention columns 940, with spurs 945 extending a short distance over the upper surface of recess 870 to retain bracket 800 centered on bracket 900. When pressure is applied to the bracket 800, forcing it onto bracket 900, spurs 945 act as cams to apply a radial force to flex retention columns inward until the lamp housing bracket 800 is in position and the retention columns 940 resile outward to apply a radial outward force against the edges of opening 865. This force provides a slight resistance against rotation of bracket 800 relative to bracket 900. Spurs 945 hold the lower surface of bracket 800 against the upper surface of bracket 900.

Also formed in the central section of bracket 900 are a plurality of rotation stops 920, which are tabs notched at their bases to generate an upward bias. Retention spur 925 is formed on the upper surface of each rotation stop 920 to cooperate with dimples 855 formed in the lower surface of bracket 800. The upward bias on rotation stops 920 force spurs 925 into dimples 855 to provide resistance to rotation of bracket 800 relative to bracket 900 until sufficient rotational force of applied to bracket 800 to overcome the resistance produced by the combination of the spurs 925 in dimples 855, the upward bias of stops 920 and the lower edge of spurs 945. This motion acts as a ratcheting mechanism to hold bracket 800 at a selected angle of rotation.

The combination of the rotation of bracket 800 about bracket 900 (rotational angle θ or azimuth in a spherical or cylindrical coordinate system), the vertical travel of rotation retainer/bracket slide 880 on lamp housing bracket arms 830 (longitudinal depth h or height in a cylindrical coordinate system), the pivoting of lamp housing 701 about the rotation disk 760 to adjust tilt angle (ϕ or zenith in a spherical coordinate system) and the lateral movement of bracket 900 relative to housing 981 (r coordinate of a spherical coordinate system) provide four degrees of adjustment of the lamp housing. The use of spacers 977 and retainer spring 975 to set the depth of the lamp (origin of the light) within the lamp housing provide a fifth possible degree of adjustment of the lamp, corresponding to an additional distance (r) adjustment, which effects beam spread at the point that the light exits the fixture.

Figure 18A:
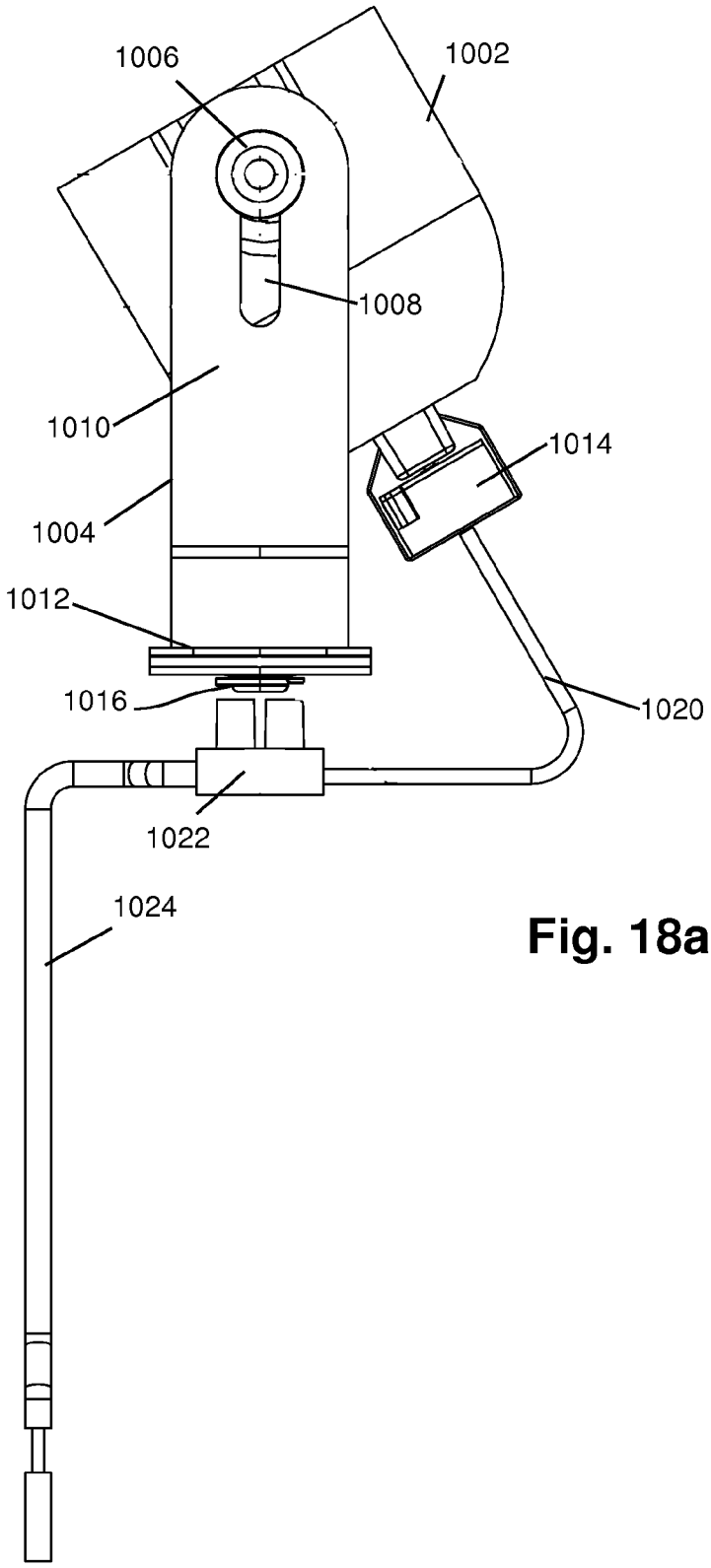
FIG. 18*a* is a side elevation of an alternative embodiment of the lamp housing assembly.
Figure 18B:
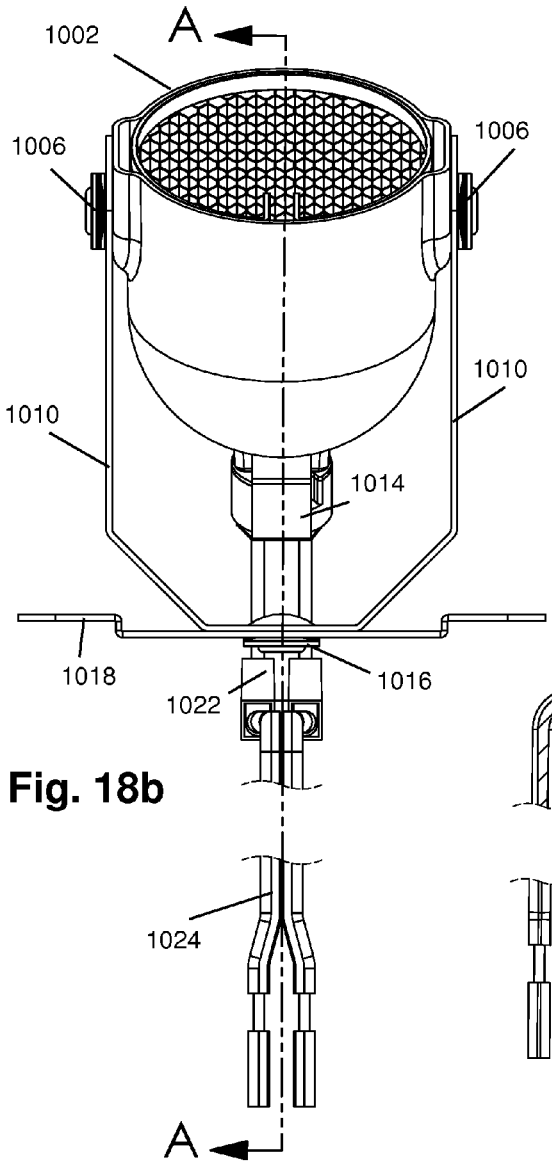
FIG. 18*b* is a front elevation of the assembly.
Figure 18C:
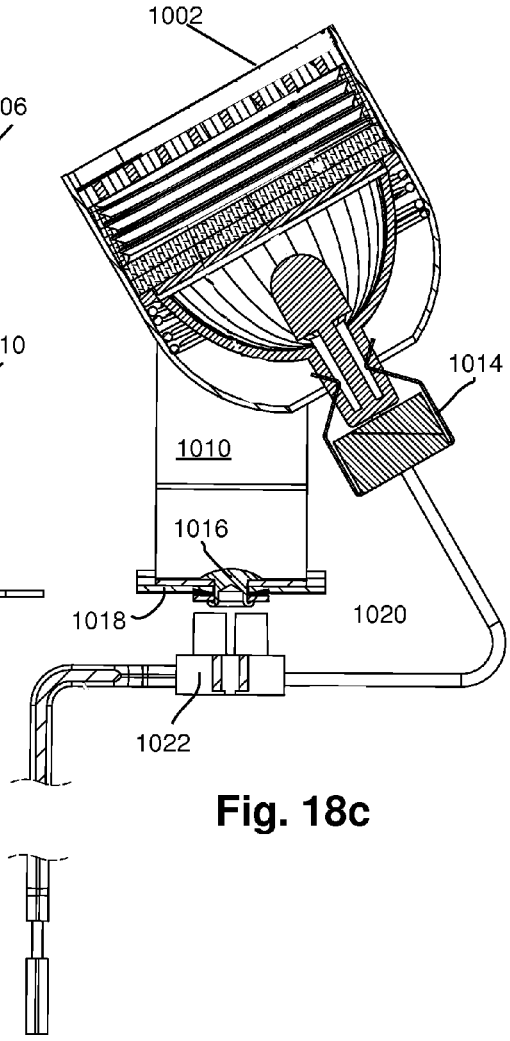
FIG. 18*c* is a cross-sectional view taken along line A-A of FIG. 18*b*.

FIGS. 18*a*-18*c* illustrate an alternative embodiment to the lamp housings described above. Lamp housing 1002, which is generally cylindrical in shape with a closed lower end, is retained within bracket 1004 by a pair of angular swivels 1006 positioned on diametrically opposite sides of the housing 1002. The housing is adapted to support the socket 1014 and to retain and enclose the lamp and a variety of filters and baffles as previously described. The swivels 1006 extend through a slot 1008 that runs parallel to the longitudinal axis of arms 1010 of bracket 1004. Swivels 1006 may be threaded to allow them to be loosened and tightened to adjust the height of the housing 1002 relative to the base 1012 of the bracket. Alternatively, the surface of each swivel that contacts the bracket surface may have a friction-producing surface, such as a rubber or silicone washer, that resists movement along slot 1008 until sufficient force is applied to overcome the resistance. In the preferred embodiment, the slot 1008 has a length that will permit vertical adjustment on the order of 1-2 cm (~0.5-1 in.), more preferably 1.5 cm (0.75 in.).

The base 1012 of bracket 1004 is connected to mounting bracket 1018 by a swivel 1016 to allow the lamp housing 1002 to be rotated around its central axis. Swivel 1016 may have a friction-producing surface contacting a surface of bracket 1018 to prevent rotation of the housing until sufficient force is applied to overcome the friction, or may have other means for releasably fixing the rotation of the housing at the desired angle, which will be readily apparent to those in the art. Mounting bracket 1018 will be attached within the lower portion of the fixture as in previous embodiments. It may be fixedly attached, such as the embodiment of FIGS. 2 and 4, but is preferably attached via adjustable fasteners extending through slots in the support bracket, similar to those of bracket 900 shown in FIGS. 9 and 10. This latter attachment scheme provides a third axis of adjustability, allowing movement of the lamp housing diametrically within the fixture.

The lamp socket 1014 at the lower end of the housing 1002 is connected to a wire harness 1020 which is sufficient long to provide slack so that the lamp housing can be moved without applying stress to the connection to socket 2014 or EURO connector 1022 that is positioned below swivel 1016. EURO connector 1022 provides connection to direct burial cable 1024, which leads out of the fixture for connection to the lighting system voltage supply (not shown).

The lighting fixture of the present invention offers wide directional variability with the entire fixture designed and adapted for in-ground or underwater use. The configuration of the present invention is aesthetically pleasing and is constructed with a focus on simplicity of use, ease of adjustment, and durability of construction.

Other embodiments and modifications of the present invention may occur to those of ordinary skill in the art in view of these teachings. Accordingly, the invention is to be limited only by the following claims which include all other such embodiments and modifications when viewed in conjunction with the above specifications and accompanying drawings.

I claim:

1. A recessed lighting fixture having multi-axis beam adjustment, comprising:

a fixture housing having an enclosed bottom and an open upper end;

a lamp assembly disposed within the fixture housing, the lamp assembly comprising:

a base bracket attached to the bottom of the fixture housing;

a generally U-shaped bracket having a base portion and a pair of arms extending from the base portion, wherein the base portion is rotatably attached to the base bracket, and wherein each arm of the pair includes a slidable attachment means; and a lamp housing having a cylindrical body adapted to receive a lamp, the cylindrical body having a pair of diametrically opposed pivots extending therefrom to cooperate with the slidable attachment means to provide rotational and linear movement of the lamp housing relative to the U-shaped bracket;

a lens disposed over the upper end of the fixture housing to enclose the upper end;

a cover for attachment to the upper end of the fixture housing to seal the lens to the upper end of the fixture housing; and at least one waterproof connector extending through the enclosed bottom of the fixture housing for providing electrical connection between the lamp assembly and an external power supply.

2. The lighting fixture of claim 1, further comprising an O-ring disposed around the lens to produce a watertight seal between the upper end of the fixture housing, the lens and a lower surface of the cover.

3. The lighting fixture of claim 1, wherein the base bracket comprises a pair of elongated slots for slidable attachment of the base bracket to the bottom of the fixture housing.

4. The lighting fixture of claim 1, wherein the U-shaped bracket is rotatably attached to the base bracket by a ratcheting assembly having a plurality of resilient stops that provide a rotational resistance to retain the U-shaped bracket at a fixed rotation relative to the base bracket until sufficient rotational force is applied to the U-shaped bracket to overcome the rotational resistance of the resilient stops.

5. The lighting fixture of claim 1, wherein the pivots extending from the lamp housing are pivotably retained within a pair of slides, wherein each slide comprises a channel adapted for sliding longitudinally along an arm of the U-shaped bracket.

6. The lighting fixture of claim 5, wherein the pivots comprise disks and the slide further comprises a partially circular cavity for pivotably retaining the disks.

7. The lighting fixture of claim 6, wherein the cavity includes a plurality of ridges along an inner surface and further comprising one or more tabs extending radially from the disks for cooperating with the ridges to resist rotation of the disks within the cavity.

8. The lighting fixture of claim 1, wherein the slide comprises a resilient tab adapted to cooperate with one or more of a plurality of dimples disposed in a surface of the arm to resist motion of the slide along the arm until sufficient force is applied to the slide to overcome resistance between the resilient tab and the dimples.

9. The lighting fixture of claim 1, wherein the lamp housing is adjustable within at least 3 axes.

10. The lighting fixture of claim 9, wherein the lamp housing is adjustable within 4 axes comprising tilt angle $\phi$, rotational angle $\theta$, longitudinal depth h and radius r.

11. The lighting fixture of claim 1, further comprising:

a bias spring disposed between a bottom of the lamp housing and a lower surface of the lamp for biasing the lamp away from the bottom of the lamp housing; and a retainer spring disposed within an inner diameter of the lamp housing to apply a downward pressure against an upper edge of the lamp to retain the lamp within the lamp housing.

12. The lighting fixture of claim 11, further comprising one or more lenses disposed between the retainer spring and the upper edge of the lamp.

13. The lighting fixture of claim 12, further comprising one or more spacers disposed between the retainer spring and the upper edge of the lamp to force the lamp further downward to depress the bias spring.

14. The lighting fixture of claim 1, further comprising a sleeve having an inner diameter adapted to slidably receive the fixture housing, wherein the sleeve is disposed within a mounting surface with an outer end flush with the mounting surface.

15. The lighting fixture of claim 1, wherein the sleeve has a boss concentrically disposed at its lower end for receiving a screw, wherein the screw comprises a first section and a second section connected at a joint to define a combined length for extending through a cement mold to hold the sleeve against the cement mold, and wherein the screw is breakable at the joint so that the first section provides means for attaching the housing within the sleeve.

16. A recessed lighting fixture having multi-axis beam adjustment, comprising:

a fixture housing having an enclosed bottom and an open upper end;

a lamp assembly disposed within the fixture housing, the lamp assembly comprising:

a base bracket attached to the bottom of the fixture housing;

a generally U-shaped bracket having a base portion and a pair of arms extending from the base portion, wherein the base portion is rotatably attached to the base bracket, and wherein each arm of the pair includes a slidable attachment means;

a lamp housing having a cylindrical body adapted to receive a lamp;

a pair of diametrically opposed pivots extending from the lamp housing to cooperate with the slidable attachment means to provide rotational and linear movement of the lamp housing relative to the U-shaped bracket;

wherein the lamp housing is adjustable within 4 axes comprising tilt angle $\phi$, rotational angle $\theta$, longitudinal depth h and radius r;

a lens disposed over the upper end of the fixture housing to enclose the upper end;

a cover for attachment to the upper end of the fixture housing to seal the lens to the upper end of the fixture housing;

at least one waterproof connector extending through the enclosed bottom of the fixture housing for providing electrical connection between the lamp assembly and an external power supply; and a sleeve having an inner diameter adapted to slidably receive the fixture housing, wherein the sleeve is disposed within a mounting surface with an outer end flush with the mounting surface.

17. The lighting fixture of claim 16, further comprising an O-ring disposed around the lens to produce a watertight seal between the upper end of the fixture housing, the lens and a lower surface of the cover.

18. The lighting fixture of claim 16, wherein the base bracket comprises a pair of elongated slots for slidable attachment of the base bracket to the bottom of the fixture housing.

19. The lighting fixture of claim 16, wherein the U-shaped bracket is rotatably attached to the base bracket by a ratcheting assembly having a plurality of resilient stops that provide a rotational resistance to retain the U-shaped bracket at a fixed rotation relative to the base bracket until sufficient rotational force is applied to the U-shaped bracket to overcome the rotational resistance of the resilient stops.

20. The lighting fixture of claim 16, wherein the pivots extending from the lamp housing are pivotably retained within a pair of slides, wherein each slide comprises a channel adapted for sliding longitudinally along an arm of the U-shaped bracket.

21. The lighting fixture of claim 20, wherein the pivots comprise disks and the slide further comprises a partially circular cavity for pivotably retaining the disks.

22. The lighting fixture of claim 21, wherein the cavity includes a plurality of ridges along an inner surface and further comprising one or more tabs extending radially from the disks for cooperating with the ridges to resist rotation of the disks within the cavity.

23. The lighting fixture of claim 16, wherein the slide comprises a resilient tab adapted to cooperate with one or more of a plurality of dimples disposed in a surface of the arm to resist motion of the slide along the arm until sufficient force is applied to the slide to overcome resistance between the resilient tab and the dimples.

24. The lighting fixture of claim 16, wherein the sleeve has a boss concentrically disposed at its lower end for receiving a screw, wherein the screw comprises a first section and a second section connected at a joint to define a combined length for extending through a cement mold to hold the sleeve against the cement mold, and wherein the screw is breakable at the joint so that the first section provides means for attaching the housing within the sleeve.

* * * * *